US009085075B2

(12) United States Patent
Ikuta

(10) Patent No.: US 9,085,075 B2
(45) Date of Patent: Jul. 21, 2015

(54) POWER TOOL

(75) Inventor: Hiroki Ikuta, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 607 days.

(21) Appl. No.: 13/480,965

(22) Filed: May 25, 2012

(65) Prior Publication Data

US 2012/0305277 A1 Dec. 6, 2012

(30) Foreign Application Priority Data

Jun. 1, 2011 (JP) ..... 2011-123303

(51) Int. Cl.
*B25F 5/00* (2006.01)
*B25D 17/24* (2006.01)

(52) U.S. Cl.
CPC ..... *B25D 17/24* (2013.01); *B25D 2211/068* (2013.01); *B25D 2217/0088* (2013.01); *B25D 2217/0092* (2013.01)

(58) Field of Classification Search
CPC ..... B25D 17/24; B25D 2217/0076; B25D 2217/0088; B25D 2217/0092; B25D 2211/068; F16F 7/1005
See application file for complete search history.

(56) References Cited

U.S. PATENT DOCUMENTS

| | | | | |
|---|---|---|---|---|
| 5,337,835 | A | 8/1994 | Bohne et al. | |
| 7,832,498 | B2 * | 11/2010 | Sugiyama et al. | 173/162.1 |
| 8,196,674 | B2 * | 6/2012 | Ikuta et al. | 173/162.1 |
| 2008/0029282 | A1 * | 2/2008 | Ikuta | 173/114 |
| 2008/0047723 | A1 * | 2/2008 | Kamegai et al. | 173/109 |
| 2008/0308287 | A1 * | 12/2008 | Sugiyama et al. | 173/211 |
| 2009/0223691 | A1 * | 9/2009 | Ikuta et al. | 173/117 |
| 2012/0118598 | A1 | 5/2012 | Iio | |

FOREIGN PATENT DOCUMENTS

| | | | | |
|---|---|---|---|---|
| EP | 1 779 979 | A1 | 5/2007 | |
| GB | 1 600 944 | | 10/1981 | |
| GB | 2 129 733 | A | 5/1984 | |
| GB | 2129733 | A * | 5/1984 | B25D 17/24 |
| JP | A-2008-307655 | | 12/2008 | |
| WO | WO 2010/128665 | A1 | 11/2010 | |

OTHER PUBLICATIONS

Extended European Search Report issued in European Application No. 12170033.0 dated Aug. 31, 2012.
Nov. 17, 2014 Office Action issued in Japan Patent Application No. 2011-123303.

* cited by examiner

*Primary Examiner* — Andrew M Tecco
(74) *Attorney, Agent, or Firm* — Oliff PLC

(57) ABSTRACT

A power tool, which actuates a tool linearly in a longitudinal direction of the tool, the power tool performs a predetermined operation to a workpiece, having: a drive mechanism which actuates the tool; a rotational shaft which actuates the drive mechanism; a swing lever which swings along the longitudinal direction by a rotational motion of the rotational shaft; and a dynamic vibration reducer which alleviates vibration generated during the predetermined operation. The dynamic vibration reducer includes a weight which is linearly movable in the longitudinal direction an elastic member which biases the weight. The weight is adapted to be actuated mechanically and forcibly by a motion component with respect to the longitudinal direction of a swinging motion of the swing lever in a state that the weight is biased by the elastic member.

8 Claims, 5 Drawing Sheets

POWER TOOL

CROSS REFERENCE TO RELATED APPLICATION

The present application claims priority from Japanese Patent Application No. 2011-123303, filed on Jun. 1, 2011, the disclosure of which is incorporated herein by reference in its entirety.

FIELD OF THE INVENTION

The invention relates to a power tool which actuates a tool linearly in a longitudinal direction of the tool and performs a predetermined operation to a workpiece.

BACKGROUND OF THE INVENTION

Japanese non-examined Patent Application Publication No. 2008-307655 discloses a power tool having a dynamic vibration reducer as vibration suppression device which alleviates vibration generated when the power tool is working. The power tool described in No. 2008-307655, has a crank mechanism which is actuated by a motor and actuates a hammering mechanism. In addition a second crank mechanism is disposed at one side of the crank mechanism opposed to the motor. The second crank mechanism actuates a weight of the dynamic vibration reducer aggressively. Namely vibration generated during an operation is decreased by forcibly actuating the dynamic vibration reducer.

However, because the crank mechanism for hammering the tool bit and the second crank mechanism for actuating the dynamic vibration reducer are disposed to be aligned with each other in an axial direction, a construction of the power tool is complicated and irrational for the purpose of weight saving of the power tool.

SUMMARY OF THE INVENTION

Problem to be Solved by the Invention

An object of the invention is, in consideration of the above described problem, to provide a power tool to improve a technique with respect to a forcible actuation of a dynamic vibration reducer.

Means for Solving the Problem

Above-mentioned object is achieved by the claimed invention. According to a preferable aspect of the invention, a power tool which actuates a tool linearly in a longitudinal direction of the tool which performs a predetermined operation to a workpiece is provided. The power tool comprising: a drive mechanism which actuates the tool; a rotational shaft which actuates the drive mechanism; a swing member which swings along the longitudinal direction by a rotational motion of the rotational shaft; and a dynamic vibration reducer which alleviates vibration generated when the tool is performing the predetermined operation. The dynamic vibration reducer includes a weight which is linearly movable in the longitudinal direction and an elastic member which biases the weight. Further the weight is adapted to be actuated mechanically and forcibly by a motion component with respect to the longitudinal direction of a swinging motion of the swing member in a state that the weight is biased by the elastic member.

A terminology of "mechanically" in the invention is defined by a feature that the dynamic vibration reducer and the swing member is connected to each other thereby a power is transmitted between the dynamic vibration reducer and the swing member. In a state that the weight is biased by a biasing force of the elastic element, the weight is actuated and alleviates vibration passively on the basis of vibration generated during the predetermined operation. A terminology of "forcibly" in the invention is defined by a feature that the dynamic vibration reducer alleviates vibration actively to be exerted vibration force as an external force which is different from vibration generated during the predetermined operation. A predetermined operation of the invention preferably includes features that a tool performs a hammering operation to make a hammering motion with respect to a longitudinal direction of the tool to a workpiece, a tool performs a hammer drill operation to make a hammering motion with respect to a longitudinal direction of the tool and a rotational motion with respect to a circumference direction of the tool to a workpiece, and a blade performs a cutting operation to make a linear motion with respect to a longitudinal direction of the blade to a workpiece.

According to the aspect, the weight of the dynamic vibration reducer is driven by the swing member which is swung by the rotational shaft for driving the tool. In this way a composition of driving the weight is simplified and lightened. Namely, driving the weight is reasonably improved. Since the composition of driving the weight is simplified, a total cost of the power tool is decreased.

According to a further preferable aspect of the invention, the power tool further comprises a rotational member which integrally rotates together with the rotational shaft. The swing member is adapted to be swung by a motion component with respect to a radial direction of a rotational motion of the rotational member. It is preferred that the rotational member is arranged within the range of a required length of the rotational shaft which is designed in advance for driving the drive mechanism, without extending the length of the rotational shaft for the purpose of arranging the rotational member. The rotational member of the invention is generally provided with a circular disk whose center is positioned at a position radially offset from a center of a rotational motion of the rotational shaft, namely the rotational member is provided with an eccentric cam. According to this aspect, because the swing member is arranged within the range of the length of the rotational shaft, the power tool is downsized with respect to a longitudinal direction of the rotational shaft.

According to a further preferable aspect of the invention, the power tool further comprises a support shaft which supports the swing member as a support point of the swinging motion of the swing member. The support shaft is arranged to be parallel to the rotational shaft. According to this aspect, a rotational motion of the rotational shaft is reasonably changed to a swinging motion of the swing member.

According to a further preferable aspect of the invention, a center of the rotational member is arranged at an eccentric position which is offset from a center of a rotational motion of the rotational shaft. A displacement of the weight by means of the motion component with respect to the longitudinal direction of the swinging motion of the swing member is defined by a displacement of the swing member and an offset distance of the rotational member. According to this aspect, the displacement of the weight is defined by adjusting the displacement of the swing member and/or the offset distance of the rotational member.

According to a further preferable aspect of the invention, the swing member includes and actuated part which is actuated by the rotational member and an actuating part which actuates the weight. A length between the support point and the actuated part is shorter than a length between the support point and the actuating part. According to this aspect, the displacement of the actuating part which actuates the weight is amplified by the displacement of the actuated part. Therefore the displacement of the swing member which drives the weight is obtained easily.

According to a further preferable aspect of the invention, the power tool further comprises a bearing which supports an intermediate part of the rotational shaft in a longitudinal direction of the rotational shaft being rotatable. The rotational shaft includes a tool actuating part which actuates the tool at one end of the rotational shaft in the longitudinal direction of the rotational shaft. The rotational member is arranged between the intermediate part and the tool actuating part in the longitudinal direction of the rotational shaft. According to this aspect, because the rotational member is arranged on the rotational shaft, a size with respect to the longitudinal direction of the rotational shaft is downsized.

According to a further preferable aspect of the invention, the power tool further comprises a rolling bearing which is arranged and intervened between the rotational member and the swing member. According to this aspect, a burning and/or a friction of contacting surfaces of the rotational member and swing member is reduced.

According to a further preferable aspect of the invention, the rotational member is provided with an eccentric cam which is arranged integrally with the rotational shaft.

According to the invention, a power tool which is effectively improved with respect to a forcible actuation of a dynamic vibration reducer is provided.

Other objects, features and advantages of the invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved power tools and method for using such the power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
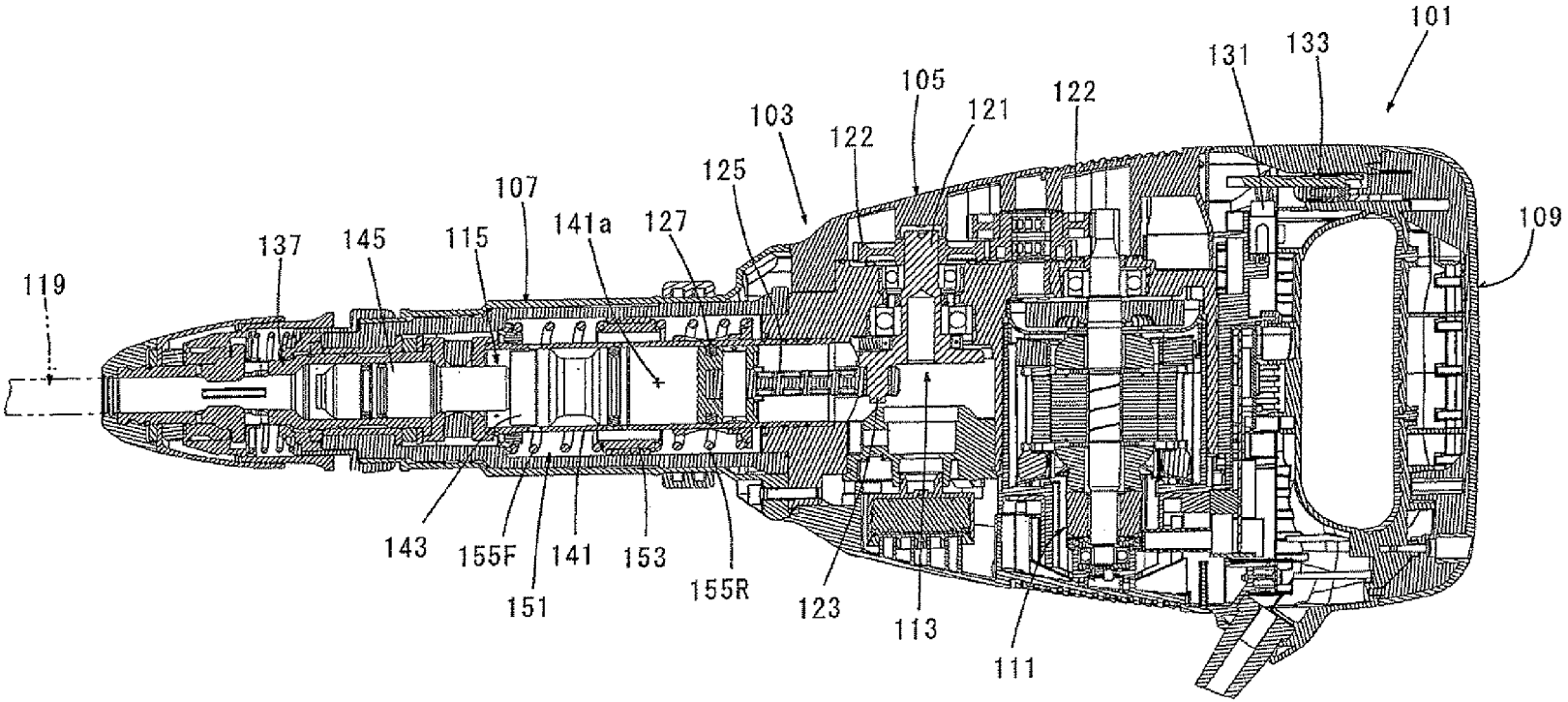
FIG. 1 shows a cross-sectional view of a total composition of an electrical hammer in accordance with an embodiment of the invention.

An embodiment of the invention will be explained with reference to FIG. 1 to FIG. 9. In this embodiment, the invention will be explained by applying to an electrical hammer as one example of a power tool. As shown in FIG. 1, the electrical hammer 101 is mainly provided with a body 103, a tool holder 137, a hammer bit 119 and a hand grip 109. The body 103 is defined as a power tool body which constitutes an outline of the electrical hammer 101. The tool holder 137 is disposed at a front part (a left side part of FIG. 1) of the body 103 in a longitudinal direction of the body 103. The hammer bit 119 is adapted to detachably connect to the tool bit 137. The hand grip 109 is defined as a main handle held by a user, which is disposed at an opposed part (a right side part of FIG. 1) with respect to the hammer bit 119 in the longitudinal direction of the body 103. The hammer bit 119 corresponds to a tool of the invention. The hammer bit 119 is held by the tool holder 137 so that the hammer bit 119 is reciprocally relatively movable against the tool holder 137 with respect to the longitudinal direction of the body 103 and is regulated to relatively rotate against the tool holder 137 with respect to a circumference direction of the tool holder 137. Hereinafter, a side where the hammer bit 119 is disposed is called a front side of the electrical hammer 101 and the other side where the hand grip 109 is disposed is called a rear side of the electrical hammer 101.

The body 103 is mainly provided with a main housing 105 and a barrel housing 107. The main housing 105 houses a driving motor 111 and a motion conversion mechanism 113. The barrel housing 107 is formed as an approximately cylindrical shape and housed a hammering element 115. The driving motor 111 is disposed to which a rotational axis extends in a vertical direction of FIG. 1 and crosses the longitudinal direction of the body 103. Namely, the rotational axis of the driving motor 111 crosses the longitudinal direction of the body 103. A rotational output of the driving motor 111 is converted to a linear motion by the motion conversion mechanism 113 and is transmitted to the hammering element 115 and thereby an impact force to the hammer bit 119 via the hammering element 115 in a longitudinal direction of the hammer bit 119 is generated. The motion conversion mechanism 113 and the hammering element 115 correspond to a drive mechanism of the invention. The barrel housing 107 is disposed at a front end of the main housing 105 and extends in the longitudinal direction of the hammer bit 119.

The hand grip 109 is disposed to extend and cross the longitudinal direction of the hammer bit 119 and has connecting portions. The connecting portions which protrude toward the front side of the electrical hammer 101 are disposed at an upper end and a lower end of the hand grip 109. The hand grip 109 is connected to the body at the upper part and the lower part, therefore the hand grip 109 is shown a substantially D-shape in a side view. A switch 131 and an operated member 133 are disposed at an upper part of the hand grip 109. The switch 131 is movable between an ON-position and an OFFposition when a user slides the operated member 133. The driving motor 111 is driven by a movement of the switch 131.

The motion converting mechanism 113 converts a rotational motion of the driving motor 111 to a linear motion and transmits the linear motion to the hammering element 115. The motion converting mechanism 113 is mainly provided with a crank mechanism which comprises a crank shaft 121, an eccentric pin 123, a connecting rod 125 and a piston 127 and so on. The crank shaft 121 is driven by the driving motor 111 via a plurality of gears and thereby the crank shaft 121 is decelerated. The eccentric pin 123 is disposed at an eccentric position which is positioned away from a rotational center of the crank shaft 121. The connecting rod 125 is connected to the crank shaft 121 via the eccentric pin 123. The piston 127 is linearly driven by the connecting rod 125. The piston 127 is disposed slidably in a cylinder 141 thereby the piston 127 is moved linearly along the cylinder 144 in association with a driving of the driving motor 111. The crank shaft 121 corresponds to a rotational shaft of the invention.

The hammering element 115 is mainly provided with a striker 143 and an impact bolt 145. The striker 143 is defined as an impacting member and is disposed in the cylinder 141 thereby the striker 143 is slidable in contact with an inner surface of the cylinder 141. The impact bolt 145 is defined as an intermediate member which transmits a motion energy of the striker 143 to the hammer bit 119 and is disposed to be slidable against the tool holder 137. An air room 141*a* is formed between the piston 127 and the striker 143 inside the cylinder 141. The striker 143 is driven via an air spring of the air room 141*a* in association with a sliding movement of the piston 127 and impinges on the impact bolt 145 which is slidably disposed against the tool holder 137. Therefore an impact power is transmitted to the hammer bit 119 via the impact bolt 145.

As to the electrical hammer 101 descried above, when the driving motor 111 is driven, the piston 127 is slid linearly along the cylinder 141 via the motion conversion mechanism 113 which is mainly composed of the crank mechanism. When the piston 127 is slid, the striker 143 is moved toward the front side in the cylinder 141 by means of an effect of the air spring of the air room 141*a* of the cylinder 141. Then the striker 143 impinges on the impact bolt 145 thereby the motion energy is transmitted to the hammer bit 119. When a user exerts a pressing force toward the front side on the body 103 and the hammer bit 119 is pressed against a workpiece, the hammer bit 119 operates a hammering operation on the workpiece such as concrete.

A dynamic vibration reducer 151 which alleviates vibration on the body 103 when the electrical hammer 101 is working, and a mechanical forcible vibration exerting mechanism 161 which exerts a movement mechanically and forcibly on the dynamic vibration reducer 151 will be explained. Hereinafter, to exert the movement forcibly on the dynamic vibration reducer 151 is called a forcible vibration exertion. As shown in FIG. 2, FIG. 7 to FIG. 9, the dynamic vibration reducer 151 is mainly provided with a weight 153 and springs 155F, 155R. The weight 153 is disposed so as to circularly surround an outside surface of the cylinder 141. The springs 155F, 155R are respectively disposed at a front side and a rear side of the weight 153 with respect to the longitudinal direction of the hammer bit 119. The dynamic vibration reducer 151 is disposed at an inner space of the barrel housing 107 of the body 103 (refer to FIG. 1). The springs 155F, 155R respectively exert an elastic force on the weight 153 from the front side and the rear side of the weight 153 when the weight 153 is moved in the longitudinal direction of the hammer bit 119. The springs 155F, 155R correspond to an elastic member of the invention.

A gravity point of the weight 153 is disposed so as to be aligned with a longitudinal axis of the hammer bit 119. An outside surface of the weight 153 is slidably disposed along the barrel housing 107 in a state that the outside surface of the weight 153 is in contact with an inner surface of the barrel housing 107. Namely the inner surface of the barrel housing 107 is defined as a guide surface which guides a linear motion of the weight 153. Similar to the weight 153, respective gravity points of the springs 155F, 155R are disposed respectively so as to be aligned with the longitudinal axis of the hammer bit 119. One end (rear end) of a spring 155R is adapted to contact with a front surface of a flange 157*a* of the slide sleeve 157 represented as a sliding member, and the other end (front end) of the spring 155R is adapted to contact with a rear end of the weight 153 with respect to the longitudinal direction. One end (rear end) of a spring 155F is adapted to contact with a front end of the weight 153, and the other end (front end) of the spring 155F is adapted to contact with a ring-shaped spring receiving member 159 which is disposed at a front side of the cylinder 141 and is fixed on the outside surface of the cylinder 141.

The slide sleeve 157 is defined as an inputting member which inputs a driving force of the forcible vibration exerting mechanism 161 to the weight 153 via the spring 155R. The slide sleeve 157 is slidably engaged with the outside surface of the cylinder 141 with respect to the longitudinal direction of the hammer bit 119 and is slid by the forcible vibration exerting mechanism 161.

Figure 3:
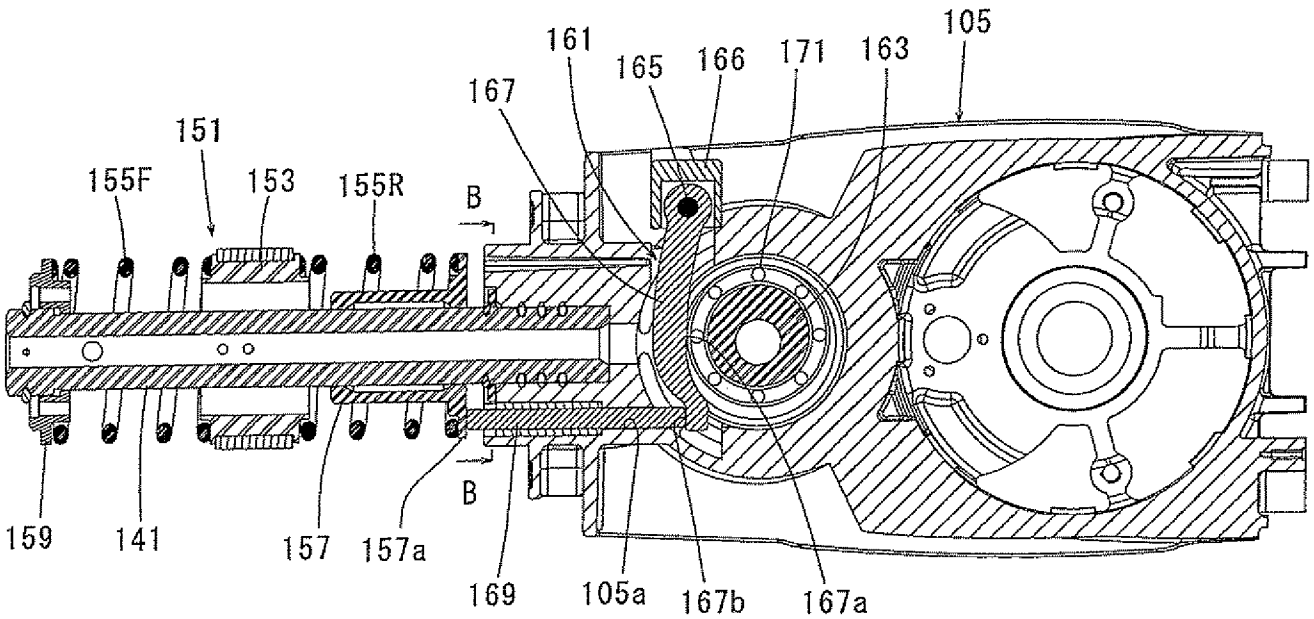
FIG. 3 shows a cross-sectional view taken from line A-A of FIG. 2.
Figure 4:
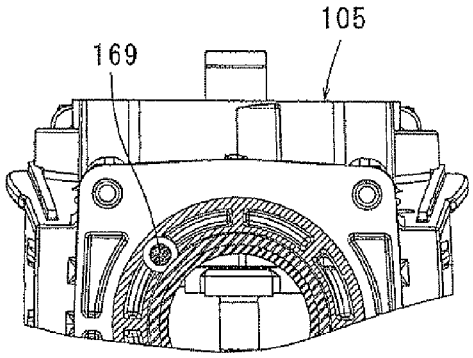
FIG. 4 shows a cross-sectional view taken from line B-B of FIG. 3.

As shown in FIG. 3, the forcible vibration exerting mechanism 161 is mainly provided with an eccentric cam 163, a support shaft 165, a swing lever 167 and a power transmission pin 169. The eccentric cam 163 is disposed on the crank shaft 121 thereby the eccentric cam 163 is integrally rotated together with the crank shaft 121. The swing lever 167 is driven by a rotational motion of the eccentric cam 163 and is swung along a front-back direction around the support shaft 165 as a swinging support point. The power transmission pin 169 transmits a motion component with respect to the longitudinal direction of the hammer bit 119 of a swinging motion of the swing lever 167 to the weight 153.

Figure 2:
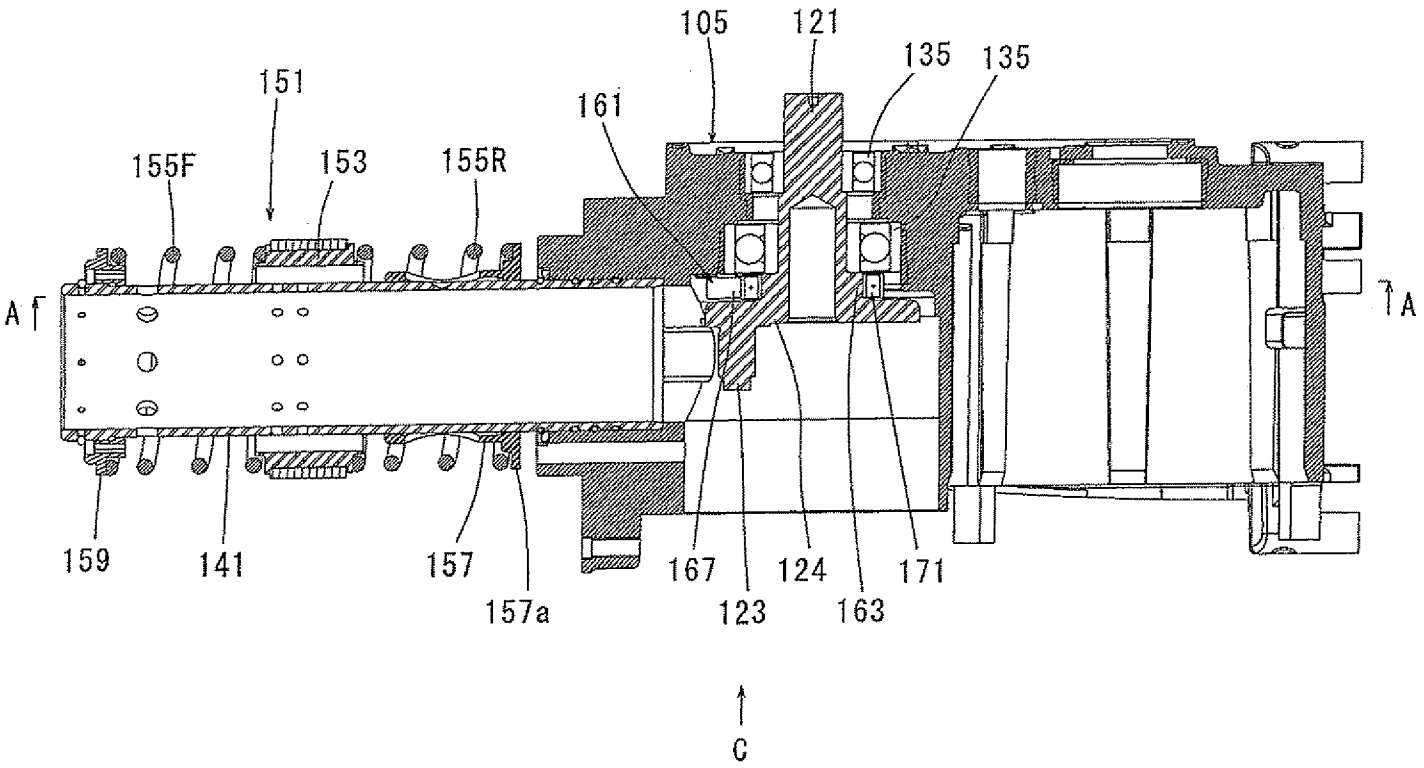
FIG. 2 shows a cross-sectional view of a dynamic vibration reducer and a surrounding area of the dynamic vibration reducer in which a motor and a gear and so on are not shown.

As shown in FIG. 2, the crank shaft 121 extends in a vertical direction crossing the longitudinal direction of the hammer bit 119. One of a plurality of gears 122 (refer to FIG. 1) which transmits the rotational output of the driving motor 111 to the crank shaft 121 is fixed at one side in an axis direction of the crank shaft 121. A crank plate 124 which communicates the eccentric pin 123 and the crank shaft 121 is arranged at the other side in the axis direction of the crank shaft 121. The crank shaft 121 is rotatably supported by the main housing 105 via two ball bearings 135 arranged between the one side and the other side of the crank shaft 121. A part between the one side and the other side in the axis direction of the crank shaft 121 corresponds to an intermediate part of the invention. The crank plate 124 and the eccentric pin 123 correspond to a tool actuating part of the invention.

As shown in FIG. 3, the eccentric cam 163 is formed as a disk member whose center is positioned at an eccentric position which is offset from a rotational center of the crank shaft 121. As shown in FIG. 2, the eccentric cam 163 is disposed between the crank plate 124 and one of the ball bearings 135 integral with the crank shaft 121. A rolling bearing 171 is engaged with a periphery of the eccentric cam 163.

As shown in FIG. 3, the swing lever 167 is disposed at a front of the crank shaft 121 so as to extend in a lateral direction crossing both a longitudinal direction of the crank shaft 121 and the longitudinal direction of the hammer bit 119. One end of the swing lever 167 is swingably supported by the support shaft 165. A front surface of a distal end of the swing lever 167 contacts with the power transmission pin 169. And a rear surface of an intermediate part between the one end and the distal end of the swing lever 167 contacts with a periphery of the rolling bearing 171. The swing lever 167 corresponds to a swing member of the invention. The distal end of the swing lever 167 which contacts with the power transmission pin 169 corresponds to an actuating part of the invention. The intermediate part of the swing lever 167 which contacts with the rolling bearing 171 corresponds to an actuated part of the invention.

Figure 5:
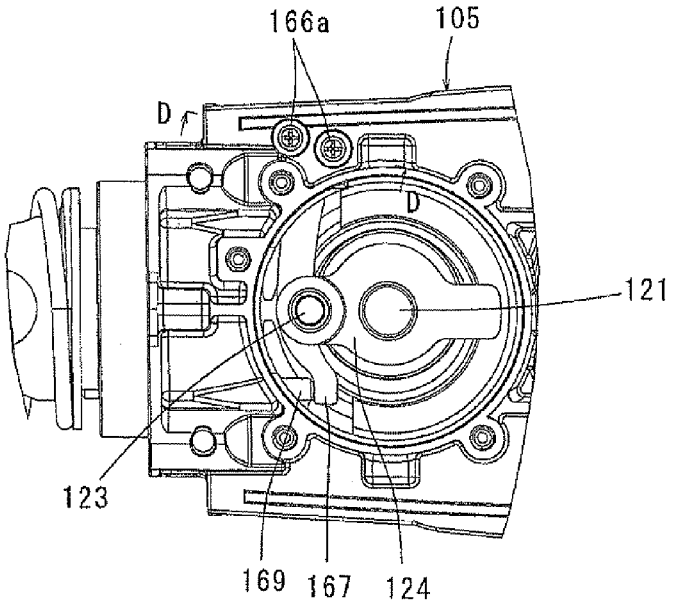
FIG. 5 shows a bottom view of FIG. 2.
Figure 6:
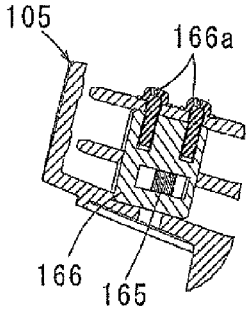
FIG. 6 shows a cross sectional view taken from line D-D of FIG. 5.
Figure 7:
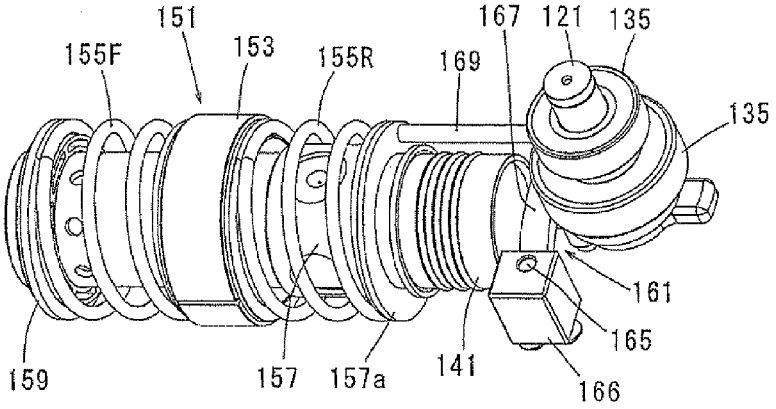
FIG. 7 shows a perspective view of a forcible vibration exerting mechanism of the dynamic vibration reducer.
Figure 8:
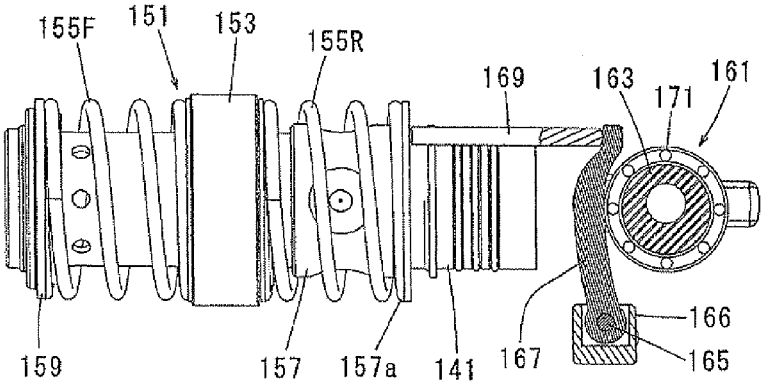
FIG. 8 shows a partial cross-sectional view of the forcible vibration exerting mechanism of the dynamic vibration reducer.
Figure 9:
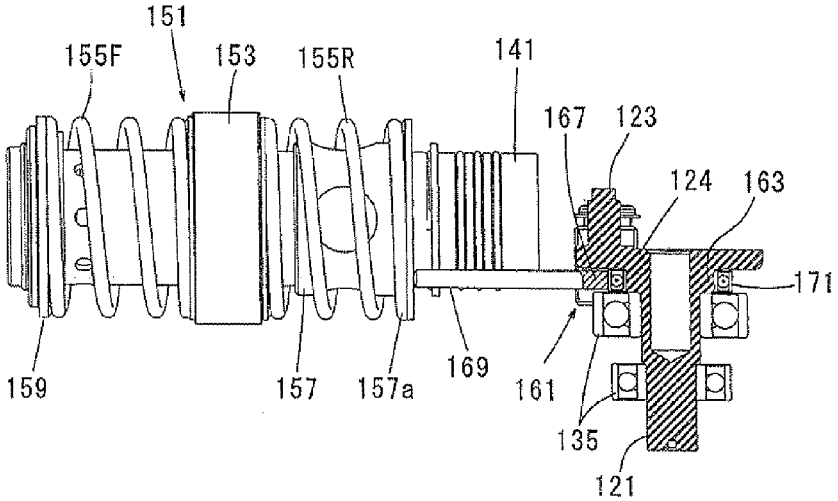
FIG. 9 shows a 90 degrees rotated partial cross-sectional view of the forcible vibration exerting mechanism of FIG. 8.

The support shaft 165 is supported by bearing 166. The swing lever 167 and the bearing 166 are assembled in advance via the support shaft 165. As shown in FIG. 5 and FIG. 6, the assembly of the swing lever 167 and the bearing 166 is arranged and fixed on the main housing 108 by fixing the bearing 166 by means of a fixing means such as a screw 166*a* and so on.

As shown in FIG. 3, the power transmission pin 169 is slidably inserted into a pin inserted hole 105*a* which is arranged at the main housing 105 so as to extend linearly in the longitudinal direction of the hammer bit 119. One end (rear end) with respect to a longitudinal direction of the power transmission pin 169 is adapted to contact with a front surface of the distal end of the swing lever 167, and the other end (front end) with respect to the longitudinal direction of the power transmission pin 169 is adapted to contact with a rear surface of a flange 157*a* of the slide sleeve 157. The end part of the power transmission pin 169 is formed sphery.

A behavior of the electrical hammer 101 described above will be explained as below. During a hammering operation by using the electrical hammer 101, an impactive and frequent vibration with respect to the hammer bit 119 is generated on the body 103. The dynamic vibration reducer 151 in this embodiment passively alleviates vibration on the body 103 by the weight 153 and the springs 155F, 155R work coactive. Therefore vibration generated on the body 103 of the electric hammer 101 is reduced effectively. During the hammering operation, for example a user operates the hammering operation by pressing the electrical hammer 101 against the workpiece. Under such circumstances, because a large load is exerted on the hammer bit 119, vibration which is input into the dynamic vibration reducer 151 is regulated.

As to an operating state described above, vibration of the body 103 is effectively reduced by the forcible vibration exertion of the dynamic vibration reducer 151. Namely when the crank shaft 121 is rotated, the eccentric cam 163 is integrally rotated together with the crank shaft 121. Then the swing lever 167 is swung in the front-rear direction by the eccentric cam 163. When the swing lever 167 is swung forward, the slide sleeve 157 is pressed and moved forward via the power transmission pin 169 thereby the springs 155F, 155R are compressed. When the swing lever 167 is swung rearward, the slide sleeve 157 is moved rearward by a biasing force of the springs 155F, 155R.

In this way, during the hammering operation the weight 153 of the dynamic vibration reducer 151 is driven actively via the springs 155F, 155R by the forcibly vibration exerting mechanism 161. Accordingly the dynamic vibration reducer 151 is represented as vibration alleviation mechanism which actively drives the weight 153. As a result, vibration with respect to the longitudinal direction of the hammer bit 119 generated during the hammering operation on the body 103 is effectively reduced.

According to this embodiment, the slide sleeve 157 is driven by the forcible vibration exerting mechanism 161 thereby the weight 153 is actively driven via the spring 155R. Therefore adjusting a driven timing of the weight 153 by the forcible vibration exerting mechanism 161 to reduce the impactive vibration generated on the body 103 when the hammer bit 119 is hit via the striker 143 and the impact bolt 145, vibration alleviation effect by the weight 153 is accomplished based on a preferable configuration.

Further, according to this embodiment, the forcible vibration exerting mechanism 161 is adapted to have the eccentric cam on the crank shaft 121 for hitting the hammer bit 119 thereby the weight 153 of the dynamic vibration reducer 151 is adapted to be driven by the eccentric cam 163 via the swing lever 167 and the power transmission pin 169. Namely the forcible vibration exerting mechanism 161 is adapted and integrated with the crank mechanism for the hammering operation. Compared to the known composition which a crank mechanism for a hammering operation and a crank mechanism for a forcible vibration exerting mechanism are aligned in each other in their longitudinal direction, the forcible vibration exerting mechanism 161 is simplified and lightened. Therefore a total cost of the electrical hammer 101 is reduced. Further, because the forcible vibration exerting mechanism 161 is disposed within a range of a length of the crank shaft 121, compared to the known composition, a size with respect to a longitudinal direction of the crank shaft is downsized.

Further, according to this embodiment, because the support shaft 165 which constitutes a support point of a swinging motion of the swing lever 167 is arranged to extend in parallel with the rotational axis of the eccentric cam 163, the rotational motion of the eccentric cam 163 is reasonably changed into the swinging motion of the swing lever 167.

Further, according to this embodiment, a displacement of the weight 153 is defined by adjusting a displacement of the swing lever 167 and/or an offset distance of the eccentric cam 163.

Further, according to this embodiment, as shown in FIG. 3, the intermediate part with respect to an extending direction of the swing lever 167 is contacted with the rolling bearing 171. Therefore a distance between a center of the support shaft 165 and a contact part 167*b* which contacts with the power transmission pin 169 is longer than a distance between the center of the support shaft 165 and a contact part 167*a* which contacts with the eccentric cam 163. Accordingly the weight 153 of the dynamic vibration reducer 151 is driven with an amplified displacement which is amplified from the eccentric distance of the eccentric cam 163.

Further, according to this embodiment, because the rolling bearing 171 is disposed at the periphery of the eccentric cam 163, a burning and/or a friction of contacting surfaces of the swing lever 167 and the rolling bearing 171 is reduced.

The electrical hammer 101 was explained as a one example of the power tool in this embodiment, however it is not limited to the electrical hammer 101. For example, the invention may be applied to a hammer drill comprising the hammer bit 119 which actuates a hammering motion and a rotational motion. In addition, the invention may be applied to a jigsaw or a reciprocal saw which operate a cutting operation by moving a blade linearly against a workpiece.

DESCRIPTION OF NUMERALS

101 electrical hammer
103 body
105 main housing

107 barrel housing
109 hand grip
111 driving motor
113 motion conversion mechanism
115 hammering element
119 hammer bit
121 crank shaft
122 gear
123 eccentric pin
125 connecting rod
127 piston
131 switch
133 operated member
135 ball bearing
137 tool holder
141 cylinder
143 striker
145 impact bolt
151 dynamic vibration reducer
153 weight
155F spring
155R spring
157 slide sleeve
157*a* flange
159 spring receiving member
161 forcible vibration exerting mechanism
163 eccentric cam
165 support shaft
166 bearing
166*a* screw
167 swing lever
167*a* contact part
167*b* contact part
169 power transmission pin
171 rolling bearing

What is claimed is:

1. A power tool, which actuates a tool linearly in a longitudinal direction of the tool, the power tool performs a predetermined operation to a workpiece, comprising:

a drive mechanism which actuates the tool;

a rotational shaft which actuates the drive mechanism;

a rotational member which integrally rotates together with the rotational shaft;

a swing member which swings along the longitudinal direction by a rotational motion of the rotational shaft, wherein the swing member is adapted to be swung by a motion component with respect to a radial direction of a rotational motion of the rotational member;

a support shaft which supports the swing member as a support point of a swinging motion of the swing member, wherein the support shaft is arranged to be parallel to the rotational shaft and the support shaft is disposed such that its position change is prevented; and a dynamic vibration reducer which alleviates vibration generated when the power tool is performing the predetermined operation, wherein the dynamic vibration reducer includes a weight which is linearly movable in the longitudinal direction and an elastic member which biases the weight, and wherein the weight is adapted to be actuated mechanically and forcibly by a motion component with respect to the longitudinal direction of the swinging motion of the swing member in a state that the weight is biased by the elastic member.

2. The power tool according to claim 1, wherein a center of the rotational member is arranged at an eccentric position which is offset from a center of the rotational motion of the rotational shaft, and wherein a displacement of the weight by means of the motion component with respect to the longitudinal direction of the swinging motion of the swing member is defined by a displacement of the swing member and an offset distance of the rotational member.

3. The power tool according to claim 2, wherein the swing member includes an actuated part which is actuated by the rotational member and an actuating part which actuates the weight, and wherein a length between the support point and the actuated part is shorter than a length between the support point and the actuating part.

4. The power tool according to claim 1, further comprising a bearing which supports an intermediate part of the rotational shaft in a longitudinal direction of the rotational shaft being rotatable, wherein the rotational shaft includes a tool actuating part which actuates the tool at one end of the rotational shaft in the longitudinal direction of the tool, and wherein the rotational member is arranged between the intermediate part and the tool actuating part in the longitudinal direction of the rotational shaft.

5. The power tool according to claim 4, further comprising a rolling bearing which is arranged and intervened between the rotational member and the swing member.

6. The power tool according to claim 1, wherein the rotational member is provided with an eccentric cam which is arranged integrally with the rotational shaft.

7. A power tool, which actuates a tool linearly in a longitudinal direction of the tool, the power tool performs a predetermined operation to a workpiece, comprising:

a drive mechanism which actuates the tool;

a rotational shaft which actuates the drive mechanism, wherein the rotational shaft includes a tool actuating part which actuates the tool at one end of the rotational shaft in the longitudinal direction of the tool;

a rotational member which integrally rotates together with the rotational shaft;

a bearing which supports an intermediate part of the rotational shaft in a longitudinal direction of the rotational shaft being rotatable, wherein the rotational member is arranged between the intermediate part and the tool actuating part in the longitudinal direction of the rotational shaft;

a swing member which swings along the longitudinal direction by a rotational motion of the rotational shaft, wherein the swing member is adapted to be swung by a motion component with respect to a radial direction of a rotational motion of the rotational member; and a dynamic vibration reducer which alleviates vibration generated when the power tool is performing the predetermined operation, wherein the dynamic vibration reducer includes a weight which is linearly movable in the longitudinal direction and an elastic member which biases the weight, wherein the weight is adapted to be actuated mechanically and forcibly by a motion component with respect to the longitudinal direction of a swinging motion of the swing member in a state that the weight is biased by the elastic member.

8. The power tool according to claim 7, further comprising a rolling bearing which is arranged and intervened between the rotational member and the swing member.

* * * * *